United States Patent [19]

Bruss et al.

[11] Patent Number: 4,627,825

[45] Date of Patent: Dec. 9, 1986

[54] APPARATUS FOR THE ANGULAR ADJUSTMENT OF A SHAFT, SUCH AS A CAMSHAFT, WITH RESPECT TO A DRIVE WHEEL

[75] Inventors: Karl-Heinz Bruss, Monchen-Gladbach; Hans Baumgartner, Viersen, both of Fed. Rep. of Germany

[73] Assignee: Pierburg GmbH & Co. KG, Neuss, Fed. Rep. of Germany

[21] Appl. No.: 728,318

[22] Filed: Apr. 29, 1985

[30] Foreign Application Priority Data

Apr. 28, 1984 [DE] Fed. Rep. of Germany ..... 3415861

[51] Int. Cl.[4] ..... F01L 1/34; F16D 3/10

[52] U.S. Cl. ..... 464/2; 123/90.15; 123/90.17; 123/90.12

[58] Field of Search ..... 123/90.15, 90.16, 90.17, 123/90.12; 464/2

[56] References Cited

U.S. PATENT DOCUMENTS

| | | | |
|---|---|---|---|
| 2,191,459 | 2/1940 | Duncan | 123/90.17 |
| 3,685,499 | 8/1972 | Meacham et al. | 123/90.15 |
| 3,721,220 | 3/1973 | Gancea | 123/90.15 |
| 4,481,912 | 11/1984 | Stwiorok et al. | 123/90.15 |
| 4,494,495 | 1/1985 | Nakamura et al. | 123/90.15 |
| 4,498,431 | 2/1985 | Nakamura et al. | 123/90.17 |
| 4,535,731 | 8/1985 | Banfi | 123/90.17 |
| 4,561,390 | 12/1985 | Nakamura et al. | 123/90.15 |

FOREIGN PATENT DOCUMENTS

| | | | |
|---|---|---|---|
| 1081718 | 5/1960 | Fed. Rep. of Germany . | |
| 1947362 | 4/1971 | Fed. Rep. of Germany . | |
| 2525746 | 6/1974 | Fed. Rep. of Germany | 123/90.15 |
| 375951 | 10/1939 | Italy | 123/90.15 |
| 1413099 | 11/1975 | United Kingdom . | |

*Primary Examiner*—Ira S. Lazarus

*Attorney, Agent, or Firm*—Roberts, Spiecens & Cohen

[57] ABSTRACT

Apparatus for the angular displacement of a shaft, such as a camshaft, with respect to a drive wheel comprising a coupling having opposed cylinders by which an active relative displacement can be effected in opposite directions. The position of the shaft and of the drive wheel is determined by pulse transmitters and sensors and is evaluated in an electronic circuit for the determination of the angular displacement and its control.

25 Claims, 8 Drawing Figures

APPARATUS FOR THE ANGULAR ADJUSTMENT OF A SHAFT, SUCH AS A CAMSHAFT, WITH RESPECT TO A DRIVE WHEEL

DESCRIPTION OF PRIOR ART

European Patent Application No. 0 069 868 discloses apparatus for the angular adjustment of a camshaft with respect to a drive wheel.

By means of this apparatus, the angular adjustment is obtained as a function of speed of rotation and load for controlling the operation of an internal combustion engine. A reference-angle position and angular rotation of the engine crankshaft which is connected to the drive wheel are detected by pulse transmitters and sensors and the signals produced are processed to form a setting-value signal.

This setting-value signal is fed to a setting device which can be driven by a plurality of drive motors and whose position is indicated as an actual-value signal by a gang potentiometer. This device is very expensive and of complicated construction and requires the availability of considerable setting power. Furthermore, the detection of the actual-value appears to be too inaccurate since the actual value is not indicated directly by the camshaft.

German Application OS No. 20 32 581 discloses apparatus for changing valve timing in which the camshaft is automatically set back for low power of the engine and set forward at higher power. For this purpose, a coupling device includes two pistons acted on by engine pressure oil within cylindrical bores. The pistons act in the same direction and are intended to produce an angular displacement. However, no means are disclosed for the resetting of this displacement, aside from possible resetting due to emergence of oil between the piston and the cylinder, whereby active displacement is possible only in one direction.

SUMMARY OF THE INVENTION

An object of this invention is to provide apparatus of the aforesaid type in which active displacement in opposite directions is possible, while the mechanical expenditure and complexity is minimized. In addition, a very precise recognition or control of the angular displacement is made possible.

In accordance with the above and further objects of the invention, there is provided apparatus for the relative angular displacement of a shaft and a drive wheel for the shaft comprising hydraulic means including at least one pair of hydraulic cylinders disposed in radial opposition in the shaft and including respective pistons which are displaceable in opposite directions in the cylinders. A three position valve means controls the flow of pressure fluid to the hydraulic cylinders for controlling relative angular displacement between the shaft and drive wheel. The three position valve means has first and second end positions and an intermediate position, and in each end position a respective cylinder is pressurized while the other cylinder is vented to effect relative angular displacement selectively in opposite directions. In the intermediate position, the cylinders are unvented and are blocked from movement.

In further accordance with the invention, the three position valve means may be directly actuated to its respective positions electromagnetically or pneumatically or in an alternative embodiment the venting of the cylinders can be controlled by electrically actuated valves.

According to a feature of the invention, the relative angular displacement between the shaft and the drive wheel is effected by balls disposed in the cylinders in contact with the pistons in the cylinders, said balls bearing against inclined surfaces of the drive wheel such that upon displacement of the pistons, the outwardly displaced ball will act on the respective inclined surface of the drive wheel to apply a force which has a component acting tangentially relative to the shaft so as to displace the drive wheel angularly with respect to the shaft.

In further accordance with the invention, the relative angular positions of the drive wheel and shaft are sensed during rotation thereof and means are provided responsive to the sensed relative angular positions of the drive wheel and shaft for producing signals for adjusting the relative angular positions. The sensing means comprises sensors respectively associated with the shaft and drive wheel, pluse transmitters respectively coupled to the shaft and drive wheel for periodically activating the sensors during each rotation thereof, counters connected to the sensors for producing signals indicative of the relative angular positions of the drive wheel and shaft and means receiving the signals from the counters for adjusting the relative angular position between the shaft and drive wheel.

By the invention there has been created a device of diversified use for controlling a coupling device which is of very simple mechanical and hydraulic construction. By the use of pulse transmitters arranged directly on the coupling member, i.e. the shaft and drive wheel, accurate detection of the displacement angle is made possible. By digitally handling the counted reference signals which characterize the angular displacement and the counted actual-valve signals, a relationship is established with a stored characteristic-control without any need for analog to digital conversion. The relative angular displacement can be effected in either direction without need for high displacement power.

BRIEF DESCRIPTION OF THE FIGURES OF THE DRAWING

Several embodiments of the invention are shown in the drawing and will be described hereafter.

DETAILED DESCRIPTION OF THE PREFERRED EMBODIMENTS

Figure 1:
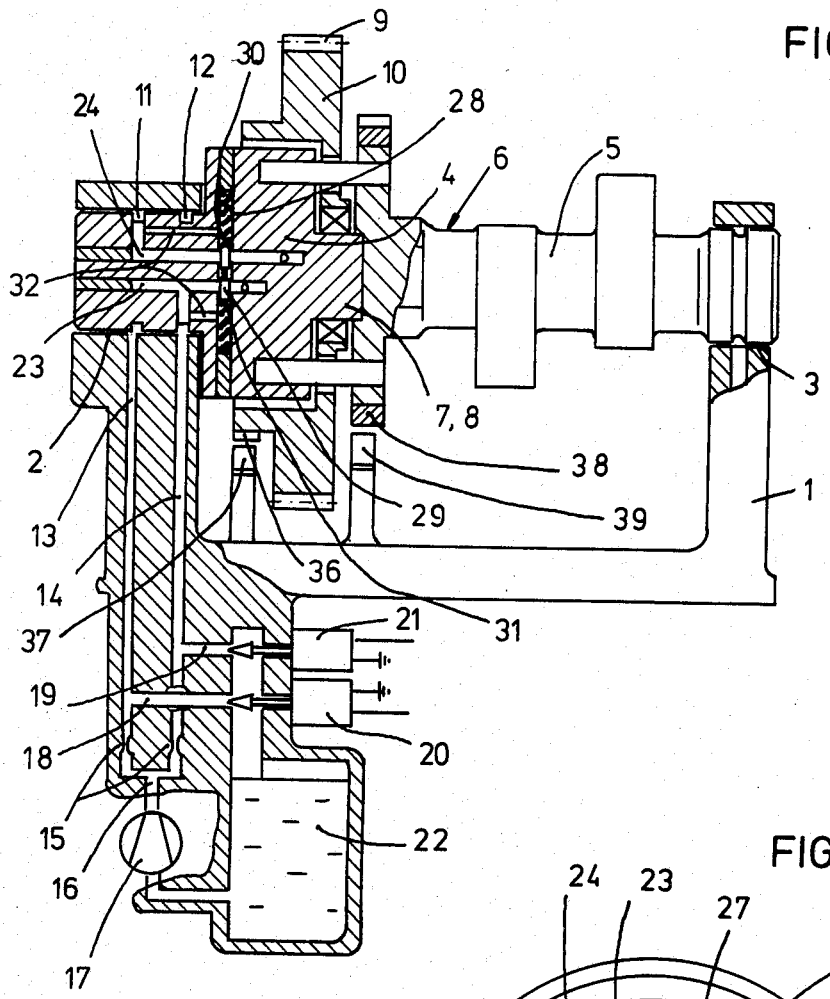
FIG. 1 shows one embodiment according to the invention, of a coupling device in side elevation, and partly in cross section

FIG. 1 shows apparatus of the invention which comprises a bearing bracket 1 having two bearings 2, 3 receiving a shaft 6 formed by two shaft parts 4, 5. A centering pin 7 on the part 4 simultaneously forms a journal shaft for a drive wheel 10 having teeth 9 as well as a centering pin for part 5. The shaft part 4 is provided, in the region of the bearing 2, with two circumferential grooves 11, 12 which are aligned with and in communication with boreholes 13, 14 in the bearing bracket 1. The grooves 11 and 12 open into the bearing 2. Each of the boreholes 13, 14 is connected via separate throttles 15 to a delivery conduit 16 of an oil pump 17. The boreholes 13, 14 are connected to respective boreholes 18, 19 whose communication with an oil reservoir 22 is controlled by respective electrically actuatable valves 20, 21.

Each of the grooves 11, 12 extends to a respective borehole 23, 24 which in turn extend to corresponding cylinders 26, 27 symmetrically arranged on shaft 6 in diametric opposition. Each cylinder, as best seen from FIG. 2 slidably receives a piston 25. A transverse borehole 28 connects the boreholes 23, 24 and receives a slide 29 which is spring-loaded at both ends and blocks communication of the boreholes 23, 24 and the cylinders 26, 27 when equal pressures prevail in the boreholes 23, 24. The end surfaces 30, 31 of the slide 29 are subjected, in each case, via a respective conduit 32 to the pressure prevailing at the boreholes 23, 24 respectively.

Figure 2:
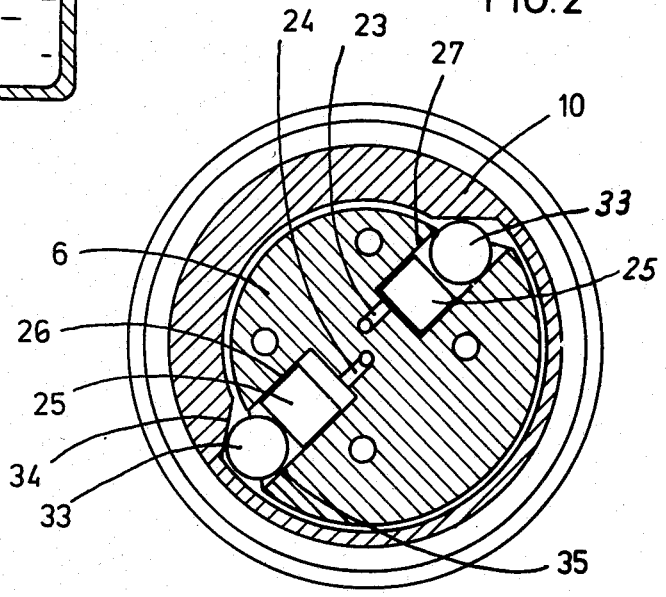
FIG. 2 is a transverse cross section through the shaft and drive wheel of the embodiment in FIG. 1.

In this way, when unequal pressure exists in the boreholes 23, 24, i.e. when one of the valves 20, 21 is open to vent the associated cylinder to the reservoir 22, the slide 29 is pushed into the borehole which has then been relieved of pressure so that the cross sections of the boreholes 23, 24 are open and oil can flow into one of the cylinders 26, 27 and out of the other. In this way, there is obtained a corresponding opposite displacement of the pistons 25, one of which pistons is pushed out of the pressurized cylinder against a ball 33. As seen in FIG. 2 each cylinder contains a respective piston and ball. Each ball faces an inclined surface 34 of the drive wheel 10 and rests against a surface 35 of the cylinder in the shaft. When the piston 25 acts to press the associated ball 33 outwardly, the ball exerts bearing force against inclined surface 34. to produce reaction force on surface 35 extending tangentially to the shaft 6 to cause angular displacement of shaft 6 relative to drive wheel 10. The angular displacement can be effected in opposite directions due to the diammetrically opposed and symmetrically arranged cylinders 26, 27. In this way, relative angular adjustment can be made between the shaft 6 and drive wheel 10 in opposite directions without interfering with the angular drive of shaft 6 from drive wheel 10.

The shaft 6 and the drive wheel 10 are coupled to pulse transmitters 36, 38 each of which is arranged at the outer circumferences thereof and the transmitters 36, 38 act on sensors 37, 39 secured to the bearing bracket 1.

Figure 3:
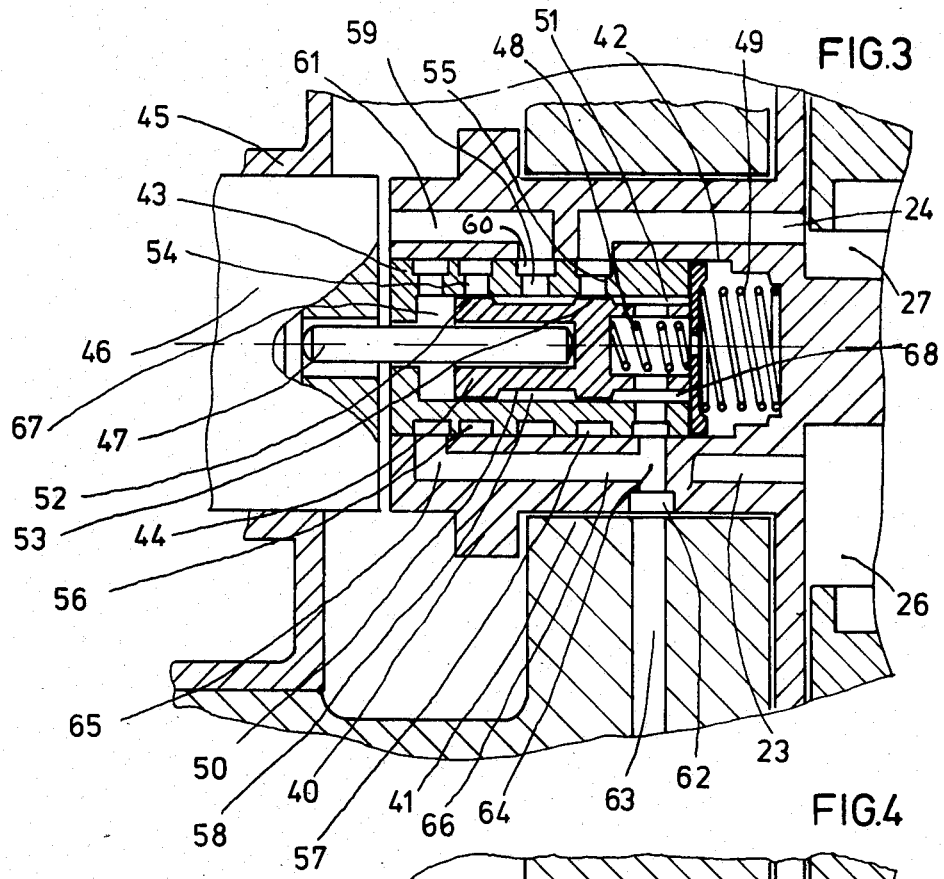
FIGS. 3, 4 and 5 are partial cross sections of the apparatus showing variations of the embodiment of FIG. 1.

FIG. 3 shows a variant of the apparatus in FIG. 1 and identical parts having the same reference numerals will not be discussed in detail.

In FIG. 3, shaft part 40, which corresponds to the shaft part 4 of the apparatus of FIG. 1, is supported on a bearing 41.

Figure 4:
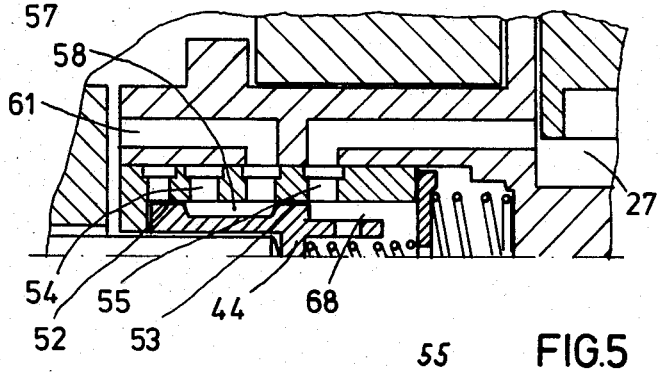
Figure 5:
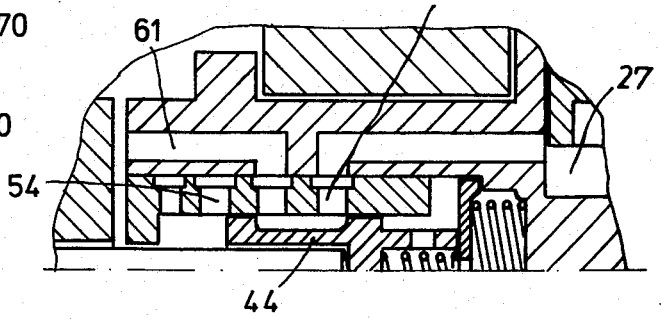

The shaft part 40 has a central axial bore 42 which receives a bushing 43 in which a slide 44 is mounted for axial displacement by a setting or actuating member 46 which is fixedly secured in a cover cap 45. The slide 44 is displaced by setting number 46 through a rod 47 inserted into the slide 44. Displacement of the slide takes place against the force of two springs 48, 49 so that three defined positions of the slide can be obtained. These positions are a center position as shown in FIG. 3 and opposite end positions as shown in FIGS. 4 and 5. The slide 44 has separated cylindrical sections 52, 53 formed by cutouts 50, 51, which act on control boreholes 54, 55 in the bushing 43 connected via outer annular grooves 56, 57 in the bushing 43 with boreholes 23, 24 which lead to the cylinders 26, 27. The space 58 which is formed by the cutout 50 between the cylinder sections 52, 53 is in communication, via a bore 59 and annular groove 60 in the bushing 43, with a relief borehole 61 which opens at the end of the shaft part 40 into the space within the cover cap 45.

In the region of the bearing 41, the shaft part 40 has a groove 62 which is connected to a borehole 63 which is in communication with the pump so that oil can flow via the groove 62 and transverse boreholes 64, 65 and via a longitudinal borehole 66 in the shaft part 50 to chambers 67, 68 formed between slide 44 and bushing 43 on the one hand, and slide 44 and the bottom of the borehole 42 on the other hand to place said chambers under pressure.

In the position of the slide shown in FIG. 3, the cylinder sections 52, 53 close the control boreholes 54, 55 so that no oil can flow into or out of the cylinders. The same condition thus exists as obtained by the slide 29 in FIG. 1.

In FIG. 4, the slide 44 is in an end position in which oil can flow from chamber 68 into the control borehole 55 and from there to the cylinder 27 while at the same time oil can flow out of the cylinder 26 since the cylinder sections 52, 53 have exposed the control boreholes 54, 55. The oil flowing out of the cylinder 26 via the control borehole 54 and the space 58 into the relief borehole 61 discharges into the space below the cover cap.

FIG. 5 shows the slide 44 in the opposite end position in which oil flows via the control borehole 54 into the cylinder 26 and oil discharges from the cylinder 27 via the control borehole 55 and the relief borehole 61.

At both end positions, the result is obtained that the particular piston 55 which is urged out of the pressurized cylinder as is shown in FIG. 2 and has already been described, acts against the ball 33, whereby the angular displacement takes place.

From the above, it is seen that the combination of the bushing and slide represent a three position valve means in the shaft having first and second end positions and an intermediate position, said valve means in each said end position venting a respective cylinder while rendering the other cylinder operative which has the effect of causing angular adjustment of the relative position of the shaft and drive member while the direction of angular adjustment is determined. In the intermediate position, the valve means causes the cylinders to be unvented and the pistons to be blocked.

In the embodiment of FIG. 1, the slide 29 also forms a three position valve means in the shaft having first and second end positions and an intermediate position. In each end position a respective cylinder is vented while the other cylinder is pressurized which has the effect of causing angular adjustment of the relative position of the shaft and drive wheel while the diredtion of angular adjustment is determined. In the intermediate position, the cylinders are unvented and the pistons are blocked.

The actuating member 46 can be of electromagnetic or pneumatic construction. The pneumatic actuator would be actuatable by corresponding pressure action selectively from a reservoir or a source of pressure under the control of a solenoid valve (not shown).

Figure 6:
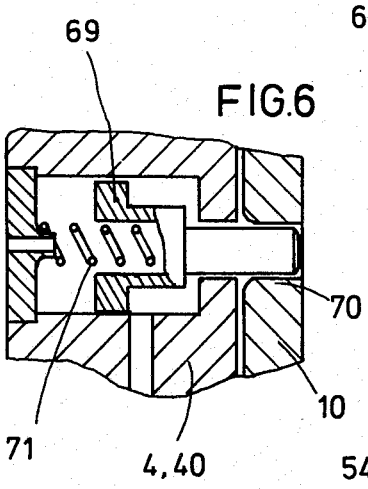
FIG. 6 is a sectional view of a detail of an interlock of the apparatus.

FIG. 6 shows a portion of the shaft part (4 or 40) and of the drive wheel 10 in which, in one of the end positions of the angular displacement between the drive wheel 10 and the shaft 6, a spring-loaded connecting element 69, in the form of a piston, engages into a bore 70 in the drive wheel 10, whereby a locked connection is produced between the drive wheel 10 and the shaft 6. This connection is released when the corresponding cylinder is acted on by oil pressure, i.e. the oil pressure acts on the connecting element 69, so that element 69 is moved against the force of a spring 71 to release the locking engagement. After displacement, a subsequent locking engagement is obtained by the connecting element 69 which is actuated as a function of the oil pressure in the other cylinder, that is since this cylinder is relieved of pressure the connecting element 69 is also relieved of pressure so that the spring 71 produces a displacement towards the drive wheel 10 and engagement of the connecting element 69 into the recess 70 when they come into alignment.

Figure 7:
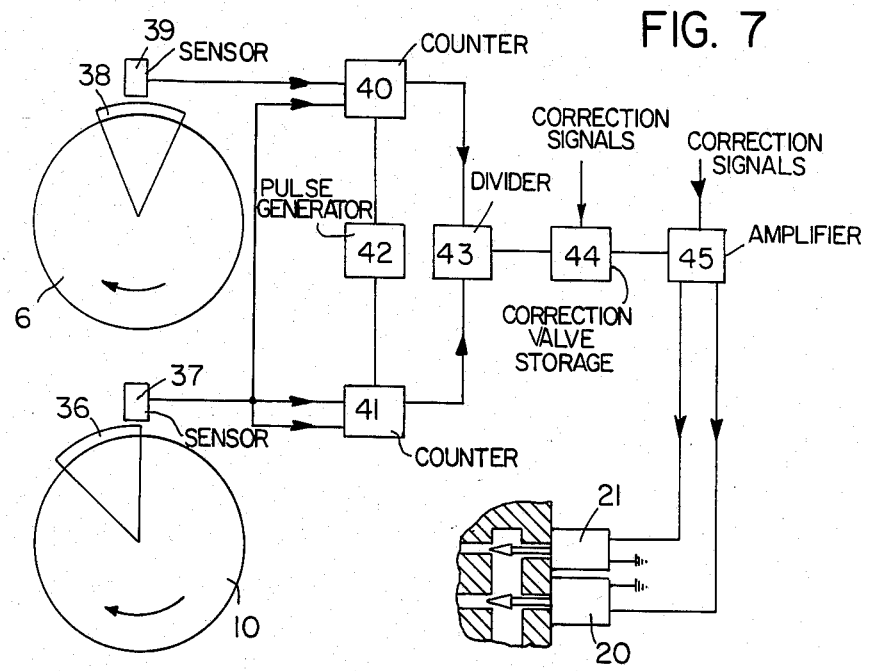
FIG. 7 is a schematic block diagram of a circuit for the detection and control of the angular displacement of the coupling members.

FIG. 7 shows a schematic block diagram in which is seen a circuit for sensing the relative angular displacement of the shaft and drive wheel and for controlling the valves 20, 21 to effect relative angular displacement in order to adjust the relative positions of the drive wheel and shaft.

The shaft 6 and the drive wheel 10 carry the pulse transmitters 36, 38 which, upon approach to the sensors 37, 39, produce a signal in the sensors.

The signal produced by the pulse transmitter 36 of the drive wheel 10 is taken as a reference signal indicative of the maximum possible angular displacement.

The signal produced by the pulse transmitter 38 of the shaft 6, represents an actual-value signal and for maximum angular displacement is advanced in time relative to the reference signal by a period equal to that of the reference signal. In other words, in a position of maximum adjustment, the transmitter 38 produces a signal in sensor 39 before transmitter 36 produces a signal in sensor 37 by a period equal to the reference signal. In FIG. 7 the shaft 6 is illustrated as being angularly adjusted about midway of its maximum advanced position relative to the drive wheel 10. The actual-value signal from sensor 39 activates a counter 40 and the reference signal from sensor 37 activates another counter 41 for the duration of the signal and concurrently stops the counter 40 at the start of the reference signal. During their activation, the counters 40, 41 count the pulses from a pulse generator 42 which operates with constant frequency. The counter outputs are fed to a divider 43 whose output is the ratio of the outputs which represents the relative angular displacement between zero and the maximum value. This output can be modified in customary manner by means of a correction-value storage 44 and optionally by means of further information signals (e.g. speed of rotation, load, etc.) to produce a correction signal which can be fed as an electrical signal via an amplifier 45 to the valves 20, 21.

Figure 8:
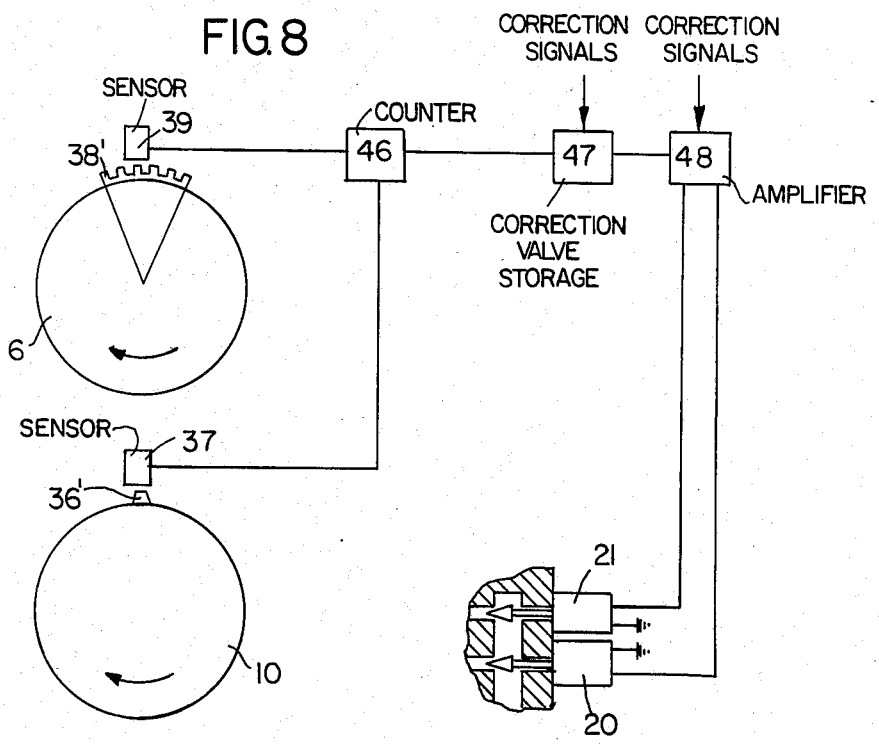
FIG. 8 is a schematic block diagram of an alternative embodiment of the circuit.

FIG. 8 shows an alternative circuit in which the shaft 6 has a plurality of pulse transmitters 38′ whose signals are counted via the sensor 39 by a counter 46 until the pulse transmitter 36′ of the drive wheel 10 produces, via the sensor 37, a signal which stops the counter 46. The output of the counter 46 is representative of the relative angular displacement of the shaft and drive wheel since a given angular displacement is associated with each counted pulse. The output signal for counter 46 can be changed by means of a correction-value storage 47, and optionally by means of further information signals, to produce a correction signal which can be fed via an amplifier 48 as an electrical signal to the valves 20, 21.

The circuits of FIGS. 7 and 8 can also be used in combination with the device of FIG. 3, in which case the apparatus does not require the means of FIG. 6 for the locking connection of the drive wheel 10 and the shaft 6 in the end positions of the angular displacement. When an electromagnetic actuator is used, the electrical signal is directly fed to the actuator and when a pneumatic actuator is used, the electrical signal operates a solenoid valve which selectively connects the actuator to a pressure source or vents the actuator to a reservoir.

A locking action is obtained between the shaft and drive wheel, in the desired angular relation thereof, by the position of the slide valve shown in FIG. 3 in which no oil can flow into or out of the cylinders thereby producing hydraulic interlocking. Alternatively or in combination the locking connection between the drive wheel 10 and shaft 6 can be obtained as shown in FIG. 6.

From the above, it is seen that the invention provides apparatus for adjusting the relative angular position between the rotating shaft member and drive member which comprises coupling means as seen in FIG. 2 for drivingly connecting the shaft member and drive member in driving relation and including means for enabling the shaft member and drive member to be relatively angularly adjustable while maintaining the driving relation therebetween, the latter means being inclusive of the hydraulic cylinders 26, 27, in radial opposition with the respective pistons 25 slidably mounted for movement in opposite directions in the cylinders. The movement of the pistons in the cylinders causes the shaft and drive members to undergo relative angular displacement in a direction corresponding to the direction of movement of the pistons. This is due to the provision of the balls 33 which act on the inclined surfaces 34 of the drive member. The flow of the pressure fluid to the hydraulic cylinders to displace the pistons is controlled by the valve means which thereby controls the relative angular position of the shaft and drive members. As seen in FIGS. 1 and 3–5, two embodiments of valve means have been shown, each of which has first and second positions in each of which a respective one of the cylinders is pressurized while the other is vented. The direction of relative angular adjustment is opposite depending on whether the valve means is in its first or second position.

In both embodiments the valve means has an intermediate position in which the pressure in the cylinders is applied respectively in opposite direction to the valve means. In the intermediate position, the cylinders are unvented and the pistons are blocked.

Although the invention has been described in relation to specific embodiments thereof, it will become apparent to those skilled in the art that numerous modifications and variations can be made within the scope and spirit of the invention as defined in the attached claims.

What is claimed is:

1. Apparatus for the relative angular displacement of a shaft and a drive wheel for said shaft in which said angular displacement is effected by hydraulic means as a function of whether or not pressure fluid is fed to the apparatus, said apparatus comprising at least one pair of hydraulic cylinders disposed in radial opposition in said shaft and including respective pistons displaceable in opposite directions in said cylinders, and three position valve means for controlling flow of pressure fluid to said hydraulic cylinders for controlling relative angular displacement between said shaft and drive wheel, said valve means having first and second end positions and an intermediate position, said valve means in each said end position pressurizing a respective cylinder while the other cylinder is vented to effect relative angular displacement selectively in opposite directions, said cylinders being unvented with the valve means in said intermediate position to block said pistons.

2. Apparatus as claimed in claim 1 wherein said shaft has boreholes constituting respective inlets to said cylinders, said valve means blocking said inlets in said intermediate position.

3. Apparatus as claimed in claim 2 comprising drive means for actuating said valve means to move the valve means between said positions.

4. Apparatus as claimed in claim 3 comprising means for setting the position of said drive means and thereby the position of said valve means.

5. Apparatus as claimed in claim 3 wherein said drive means is electromagnetic.

6. Apparatus as claimed in claim 3 wherein said drive means is pneumatic.

7. Apparatus as claimed in claim 3 wherein said drive means comprises means responsive to pressure difference between said inlets.

8. Apparatus as claimed in claim 7 comprising outlet bores for respectively venting each cylinder, a reservoir connected to said outlet bores, said outlet bores being respectively connected to said inlets and electrically actuatable valves for respectively blocking communication between said outlet bores and said reservoir.

9. Apparatus as claimed in claim 1 comprising a ball in each cylinder in bearing contact with said shaft, the piston in each cylinder bearing under pressure against the respective ball when said cylinder is pressurized, and a drive wheel surrounding said shaft and in bearing contact with the balls under the action of the pressurized pistons to produce forces on said balls acting tangentially of said shaft.

10. Apparatus as claimed in claim 9 wherein said drive wheel has surfaces against which the balls are in contact, said surfaces being inclined with respect to the axes of the cylinders.

11. Apparatus as claimed in claim 1 further comprising mechanical locking means for producing a locked connection between said shaft and said drive wheel in predetermined, relative angular positions thereof.

12. Apparatus as claimed in claim 11 wherein said locking means comprises a spring-loaded connecting element, said shaft and drive wheel having recesses in which said connecting element is engaged under its spring loading to produce said locked connection, and means for subjecting said connecting element to the pressure of the pressure fluid with said valve means in said end positions to retract said connecting element from said recesses and thereby release said locked connection.

13. Apparatus as claimed in claim 4 comprising means for sensing the relative angular positions of said drive wheel and said shaft during rotation thereof, and means responsive to the sensed relative angular positions of the drive wheel and shaft for producing signals for adjusting said relative angular positions.

14. Apparatus as claimed in claim 13 wherein said sensing means comprises sensors respectively associated with said shaft and said drive wheel, pulse transmitters respectively coupled with said shaft and drive wheel for periodically activating the sensors during each rotation thereof, counter means connected to said sensors for producing signals indicative of the relative angular positions of the drive wheel and shaft and means receiving the signals from the counter means for supplying signals to said setting means for setting the position of said valve means when the relative angular position between the shaft and drive wheel is to be adjusted.

15. Apparatus as claimed in claim 14 wherein said means which supplies signals to the setting means forms a ratio of signals from said counter means representing angular offset between the shaft and drive wheel and a reference angle.

16. Apparatus as claimed in claim 14 wherein the counter means receives a reference signal from one of said sensors and counted signals from the other of said sensors indicating relative angular offset of the shaft and drive wheel.

17. Apparatus as claimed in claim 8 comprising means for sensing the relative angular positions of said drive wheel and said shaft during rotation thereof, and means responsive to the sensed relative angular positions of the drive wheel and shaft for producing signals for adjusting said relative angular positions.

18. Apparatus as claimed in claim 17 wherein said sensing means comprises sensors respectively associated with said shaft and said drive wheel, pulse transmitters respectively coupled with said shaft and drive wheel for periodically activating the sensors during each rotation thereof, counter means connected to said sensors for producing signals indicative of the relative angular positions of the drive wheel and shaft and means receiving the signals from the counter means for supplying signals to said electrically actuatable valves for selectively venting the cylinders to the reservoir when the relative angular position between the shaft and drive wheel is to be adjusted.

19. Apparatus as claimed in claim 18 wherein said means which supplies signals to the electrically actuatable valves forms a ratio of signals from said counter means representing angular offset between the shaft and drive wheel and a reference angle.

20. Apparatus as claimed in claim 18 wherein the counter means receives a reference signal from one of said sensors and counted signals from the other of said sensors indicating relative angular offset of the shaft and drive wheel.

21. Apparatus for adjusting the relative angular position between a rotating shaft member and a drive member for said shaft member, said apparatus comprising coupling means for drivingly connecting the shaft member and the drive member in driving relation, said coupling means including means for enabling said shaft member and drive member to be relatively angularly adjustable while maintaining the driving relation therebetween, the latter means including a pair of hydraulic cylinders in radial opposition in one of said members and respective pistons slidably mounted for movement in opposite directions in said cylinders, the movement of said pistons in said cylinders causing the shaft member and drive member to undergo relative angular displacement in a direction corresponding to the direction of movement of the pistons, means for providing pressure fluid, and valve means for controlling flow of the pressure fluid to said hydraulic cylinders for displacing said pistons and thereby controlling the relative angular position of said shaft and drive members, said valve means having first and second positions in each of which a respective one of said cylinders is pressurized while the other is vented, the direction of relative angular adjustment being opposite with said valve means in said first and second positions.

22. Apparatus as claimed in claim 21 wherein said valve means has an intermediate position in which the pressure in said cylinders is applied respectively in opposite directions to said valve means.

23. Apparatus as claimed in claim 21 wherein said coupling means further comprises a ball in each cylinder in bearing contact with said one member, the piston in each cylinder bearing under pressure against the respective ball when said cylinder is pressurized, the other of said members surrounding said one member and in bearing contact with the balls under the action of the pressurized pistons to produce forces in said balls acting tangentially of said one member.

24. Apparatus as claimed in claim 23 wherein said other member has surfaces against which the balls are in contact, said surfaces being inclined with respect to the axes of the cylinders.

25. Apparatus as claimed in claim 21 comprising means for sensing the relative angular positions of said drive member and said shaft member during rotation thereof, and, means responsive to the sensed relative angular positions of the drive member and shaft member for producing signals for adjusting said relative angular positions, said sensing means comprising sensors respectively associated with said shaft member and said drive member, pulse transmitters respectively coupled with said shaft member and drive member for periodically activating the sensors during each rotation thereof, counter means connected to said sensors for producing signals indicative of the relative angular positions of the drive member and shaft member and means receiving the signals from the counter means for adjusting the relative angular position between the shaft member and drive member.

* * * * *